US007532171B2

(12) United States Patent
Chandler

(10) Patent No.: US 7,532,171 B2
(45) Date of Patent: May 12, 2009

(54) MILLIMETER WAVE ELECTRONICALLY SCANNED ANTENNA

(75) Inventor: Cole A. Chandler, Weatherford, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/421,504

(22) Filed: Jun. 1, 2006

(65) Prior Publication Data

US 2006/0273972 A1 Dec. 7, 2006

Related U.S. Application Data

(63) Continuation-in-part of application No. 11/142,982, filed on Jun. 2, 2005, now abandoned.

(51) Int. Cl.
*H01Q 11/02* (2006.01)
*H01Q 1/38* (2006.01)

(52) U.S. Cl. ..... 343/731; 343/700 MS

(58) Field of Classification Search ..... 343/700 MS, 343/731, 757
See application file for complete search history.

(56) References Cited

U.S. PATENT DOCUMENTS

| | | | | |
|---|---|---|---|---|
| 3,471,864 | A * | 10/1969 | Kummer | 342/368 |
| 5,359,334 | A * | 10/1994 | Gutman | 342/408 |
| 5,694,498 | A | 12/1997 | Manasson et al. | 385/15 |
| 5,796,881 | A | 8/1998 | Manasson et al. | 385/9 |
| 5,864,317 | A | 1/1999 | Boe et al. | 342/374 |
| 6,061,035 | A | 5/2000 | Kinasewitz et al. | 343/853 |
| 6,184,828 | B1 | 2/2001 | Shoki | 342/372 |
| 6,535,168 | B1 * | 3/2003 | Marumoto et al. | 343/700 MS |
| 6,559,737 | B1 * | 5/2003 | Nagra et al. | 333/156 |
| 6,950,590 | B2 * | 9/2005 | Cheung et al. | 385/129 |
| 7,170,446 | B1 * | 1/2007 | West et al. | 342/372 |
| 2003/0043085 | A1 | 3/2003 | Park et al. | 343/770 |

FOREIGN PATENT DOCUMENTS

| | | |
|---|---|---|
| GB | 2076225 | 11/1981 |
| GB | 2243491 | 10/1991 |
| GB | 2407920 | 5/2005 |

OTHER PUBLICATIONS

PCT Search Report Dated Nov. 30, 2006 for PCT/US06/021341.
XP-002407648—Array Feeds, 1998.
"Low-Loss Distributed MEMS Phase Shifter," by Borgioli, et al; IEEE Microwave and Guided Wave Letters, vol. 10, No. 1, Jan. 2000.

(Continued)

*Primary Examiner*—Shih-Chao Chen
(74) *Attorney, Agent, or Firm*—Williams, Morgan & Amerson, P.C.

(57) ABSTRACT

A millimeter wave electronically scanned antenna is disclosed in both passive and active implementations. The antenna comprises a plurality of antenna components, wherein an antenna component, includes a coupler; a ground plane; a traveling wave phase shift line electrically connected to the coupler and grounded to the ground plane; and a plurality of fixed phase shifters, each fixed phase shifter electrically connected to the traveling wave phase shift line at a respective point thereon. One such component includes a plurality of radiating elements electromagnetically connected to a respective one of the fixed phase shifters. The antenna further includes a coupling component to which the radiating antenna is coupled to receive control signals and a radio frequency feed.

57 Claims, 13 Drawing Sheets

OTHER PUBLICATIONS

"14GHz MEMS 4-bit Phase Shifter on Silicon," by Kingsley, et al; 2004 Topical Meeting on Silicon Monolithic Integrated Circuits in RF Systems.

"Microstrip Patch Array with Multiple Beams," by Hall, et al; School of Electrical Engineering and Science, Royal Military College of Science, UK, 1989.

* cited by examiner

MILLIMETER WAVE ELECTRONICALLY SCANNED ANTENNA

This is a continuation-in-part of application Ser. No. 11/142,982, entitled "Millimeter Wave Passive Electronically Scanned Antenna", filed Jun. 2, 2005, now abandoned in the name of the inventor Cole A. Chandler and commonly assigned herewith. This application is hereby incorporated by reference as if expressly set forth herein verbatim.

BACKGROUND OF THE INVENTION

1. Field of the Invention

The present invention is directed to millimeter wave antennas, and, more particularly, to a millimeter wave electronically scanned antenna.

2. Description of the Related Art

Mechanically scanned antennas classically used on millimeter wave seeker systems suffer from a variety of problems including high cost, limited scanning performance, and low reliability. Electronically scanned antennas have greatly improved scanning performance and high reliability, but using traditional techniques have been too costly to implement and suffered from low efficiency (gain). Traditional passive electronically scanned phased arrays use multi-bit phase shifters to achieve electronic beam steering. At millimeter wavelengths the loss is typically 1 dB per bit. The multi-bit phase shifting element is responsible for the high cost and low efficiency using the classical design approach.

A conventional electronically scanned antenna requires multi-bit phase shifters (between 5-8 bits) to accomplish beam steering. The insertion loss, as mentioned above, of the phase shifter at Ka band is approximately 1 dB per bit. The associated loss of the typical phase shifting element prohibits the use of the passive electronically scanned antenna in a high performance active missile radar seeker. The Active electronically scanned antenna T/R module adds amplification on both transmit and receive to mitigate the loss of the phase shifter. Additionally, the classic T/R module approach at Ka band is very demanding due to the tight spacing, low efficiency, high gain/power required to overcome losses, the high transmit/receiver isolation necessary to prevent module oscillation, and the added complexity of multi-bit phase and attenuation control.

The present invention is directed to resolving, or at least reducing, one or all of the problems mentioned above.

SUMMARY OF THE INVENTION

A millimeter wave electronically scanned antenna is disclosed in both passive and in active embodiments. The antenna comprises a plurality of antenna components, wherein an antenna component, includes a coupler; a ground plane; a traveling wave phase shift line electrically connected to the coupler and grounded to the ground plane; and a plurality of fixed phase shifters, each fixed phase shifter electrically connected to the traveling wave phase shift line at a respective point thereon. One such component includes a plurality of radiating elements electromagnetically connected to a respective one of the fixed phase shifters. The antenna further includes a coupling component to which the radiating antenna is coupled to receive control signals and a radio frequency feed.

BRIEF DESCRIPTION OF THE DRAWINGS

The invention may be understood by reference to the following description taken in conjunction with the accompanying drawings, in which like reference numerals identify like elements, and in which:

- FIG. 10A is a conceptualization of the functional inter-relationships of the various parts of the radiating antenna component;
- FIG. 10B is an exploded, perspective view of a portion of the radiating antenna component illustrating the six layers thereof;
- FIG. 10C is a cross-section of a portion of the radiating antenna component;
- FIG. 10D illustrates edge connectors for radio frequency ("RF") signals input to the radiating antenna component;
- FIG. 10E illustrates the control elements of the radiating antenna component; and
- FIG. 10F-FIG. 10G illustrates functionality the control elements of the radiating antenna component, first shown in FIG. 10E, and of a coupling antenna component with which the radiating antenna component may be used;

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 1A:
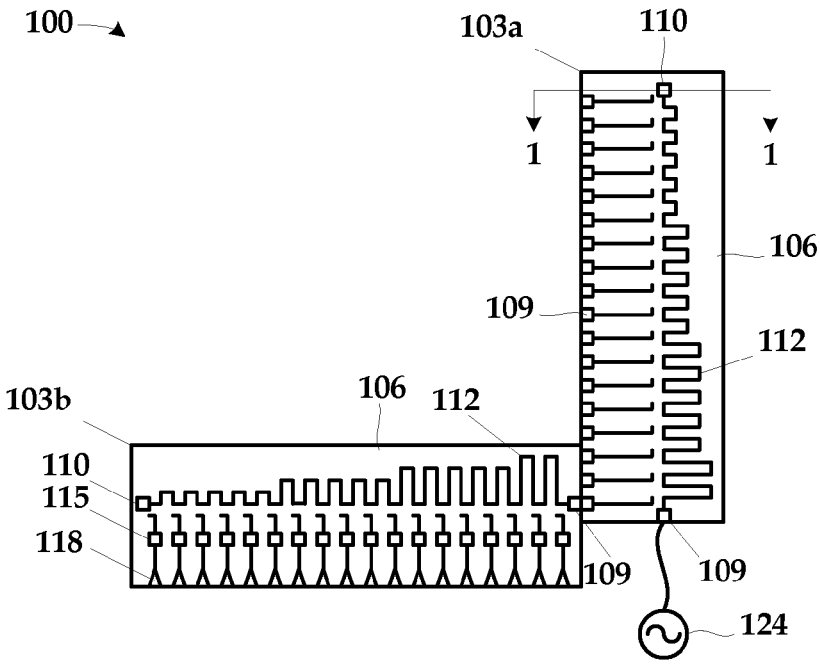
FIG. 1A-FIG. 1F illustrate a subassembly comprising two antenna components in accordance with one aspect of the present invention.
Figure 1B:
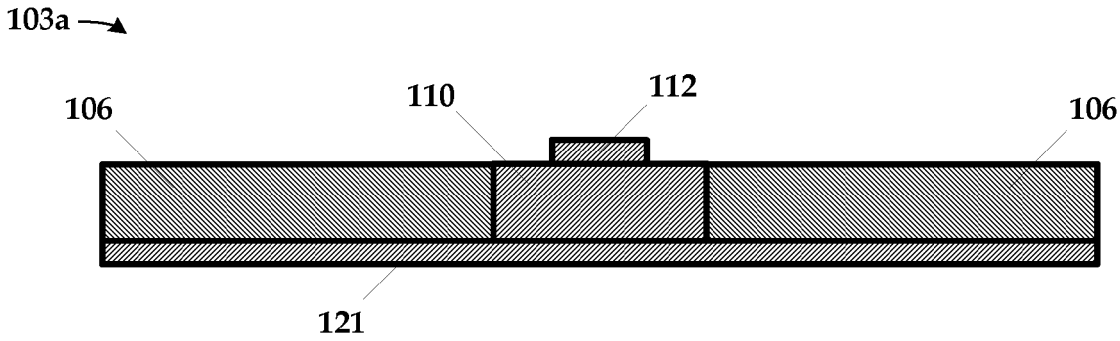

FIG. 1A illustrates a subassembly 100 comprising two antenna components 103*a*, 103*b* in an unassembled view and FIG. 1B is a plan, sectional view of the antenna component 103*a* along line 1-1 in FIG. 1A. Each of the antenna components 103*a*, 103*b* includes a substrate 106. A coupler 109 is formed in the substrate 106. A traveling wave phase shift line 112 is also fabricated in the substrate 106 and is electrically connected to the coupler 109. A plurality of one-bit fixed phase shifters 115 (only one indicated) are also fabricated in the substrate 106, each one-bit fixed phase shifter 115 capable of being coupled to the traveling wave phase shift line 112 at a respective point thereon. Note that alternative embodiments may employ alternative fixed phase shifters.

As is shown in FIG. 1B, a ground plane 121 is insulated from the traveling wave phase shift line 112 by the substrate 106 except where electrically connected through an interconnect 110. Note that the ground plane 121 is a planar member forming a backplane for the antenna components 103*a*, 103*b*. However, this is not necessary to the practice of the invention. The ground plane 121 need not necessarily be a planar member in all embodiments. Nor must the ground plane 121 form a backplane for the antenna components 103*a*, 103*b*. As is discussed in more detail below, the illustrated embodiment is fabricated using microstrip technology, and the planar member and backplane characteristics flow from that design choice. In alternative embodiments, the ground plane 121 may be implemented in some alternative fashion. Similarly, in some alternative embodiments, the couplers 109 may be implemented such that it provides the electrical interconnect between the traveling wave phase shift line 112 and the ground plane 121.

Returning to FIG. 1A, the antenna component 103*b* further comprises a plurality of radiating elements 118 (only one indicated) fabricated in the substrate 106. The radiating elements 118 of the illustrated embodiments are fabricated as slot elements, but alternative embodiments may fabricate them as patch, flared notch, or dipole radiating elements. Thus, the radiating elements 118 of the illustrated embodiment are, by way of example and illustration, but one means for radiating energy and alternative embodiments may employ other means. In general, patch elements are suitable for planar architectures, are low cost and lightweight, and have adequate bandwidth (sensitive to small variations), but experience increased coupling that might cause some anomalies. Flared notch elements are suitable for the "slat" approach of the illustrated embodiment, are low cost, have a large bandwidth, work well in high density environments, and offer design flexibility, but are not as prone to tolerances as the patch elements. In general, any suitable radiating element can be used as long as the spacing constraints are met in accordance with the present invention as discussed further below. Each radiating element 118 of the illustrated embodiment is electromagnetically connected to a respective one of the one-bit fixed phase shifters 115. In the illustrated embodiment, the radiating elements 118 are uniformly distributed.

The one-bit fixed phase shifters 115 of the illustrated embodiment are implemented as monolithic microwave integrated circuits ("MMICs") phase shifters. One suitable, commercially available MMIC phase shifter is 5-bit, Ka Band MMIC phase shifter sold under the mark TGP2102-EPU by:

TriQuint Semiconductor, Inc.
2300 NE Brookwood Parkway
Hillsboro, Oreg. 97124
USA
Phone: 503.615.9000
Fax: 503.615.8900
Internet: http://www.triquint.com/

This particular phase shifter will be modified by extracting and repackaging the 180° bit therein. However, other phase shifters may be employed. Some alternative embodiments may also employ micro-electromechanical systems ("MEMS") switches. In general, the one-bit fixed phase shifters 115 can be implemented through any means as long as bi-phase (a/k/a 1-bit) or two states are achievable.

The antenna components 103*a*, 103*b* of the illustrated embodiment are a microstrip technology for operation a higher millimeter-wave frequencies, e.g., V, W, Ku, and Ka band frequencies. The antenna components 103*a*, 103*b* may therefore be fabricated using microstrip fabrication techniques modified to implement the invention. Such microstrip fabrication techniques are well known in the art and those skilled in the art will be able to readily adapt conventional techniques to the present invention. However, alternative embodiments may employ alternative technologies, such as printed circuit board ("PCB") or printed wiring board ("PWB") technologies that will also be readily adaptable.

For instance, returning to the illustrated embodiment, significant design considerations for the material of the substrate 106 in a microstrip application may include:

(1) the microwave dielectric characteristics, such as the dielectric constant, frequency dependence of the dielectric constant, and the dielectric loss;
(2) surface characteristics, such as finish, flatness and surface adhesion for conductor coatings;
(3) thermal characteristics, such as expansion and conductivity;
(4) dimensional stability over time; and
(5) for high vacuum applications where outgassing is undesirable, the porosity.

As a practical matter, factors such as cost and ease of use during fabrication may also be considerations. This list is neither exclusive nor exhaustive. For instance, high vacuum applications may consider the degree a material outgases when placed under a vacuum. The selection, number, and weight of these and other considerations in any given embodiment will be implementation specific.

Common classes of materials that may be used as substrate materials in microstrip fabrication include plastics, sintered ceramics, glasses, and single crystal substrates. Table 1 sets forth some exemplary materials with summary descriptions of the factors that may be a consideration in any given application. These exemplary materials include, but are not limited to a plastic, a ceramic (e.g., a Low Temperature Co-Firing Ceramic, or "LTCC"), a single crystal sapphire, single crystal Gallium Arsenide ("GaAs"), single crystal Silicon ("Si").

TABLE 1

Summaries of Exemplary Substrate Materials

| Material | General Summary |
|---|---|
| Plastics | good cost, ease of use, surface adhesion; poor microwave dielectric properties, dimensional |

TABLE 1-continued

Summaries of Exemplary Substrate Materials

| Material | General Summary |
|---|---|
| | stability, thermal expansion properties, and thermal conductivity |
| Sintered Ceramics | difficult to use; good microwave loss, dispersive characteristics; thermal properties, dimensional stability, dielectric strength; poor costs relative to plastics |
| Single Crystal Sapphire | used for demanding applications, e.g., very compact circuits at high frequencies; difficult to use, poor cost and size; good dielectric constant, dielectric loss, thermal properties and surface polish |
| Single Crystal GaAs | used for monolithic microwave integrated circuits ("MMICs"); poor cost |
| Single Crystal Si | used for MMICs |

The dielectric strength of ceramics and of single crystals is much greater than that for plastics. Consequently, the power handling abilities are correspondingly higher and the breakdown of high Q-filter structures correspondingly less of a problem. In general, it is more desirable to have a high dielectric constant substrate and a slow wave propagation velocity to reduce the radiation loss from the circuits. However, at the higher frequencies the circuits get very small, which restricts the power handling capability. High frequency application therefore may wish to employ an alternative material, such as fused quartz.

In general, substrate material selection will be implementation specific and may vary among alternative embodiments. One particular material contemplated by the present invention for use as a substrate is a microwave substrate material commercially available and sold under the mark RO3003 DUROID, a single crystal GaAs material, by:

Rogers Corporation
One Technology Drive
PO Box 188
Rogers, Conn. 06263-0188
USA
Phone: 860.774.9605
Fax: 860.779.5509
Internet: http://www.rogerscorporation.com However, other commercially available, or otherwise known, materials may be suitable.

The material selection for other elements such as the couplers 109, the traveling wave phase shift line 112, the ground plane 121, and the interconnect 110 may be any electrically conductive material. Factors in material selection may include, for example, cost, ease of use, electrical conductivity, heat dissipation, power handling, and durability. Again, this list is neither exclusive nor exhaustive. In general, metals such as gold or copper may be used, although other materials may be suitable.

Returning now to FIG. 1A, the antenna components 103*a*, 103*b* are shown oriented vertically and horizontally, respectively. This orientation is for illustrative purposes only. As those in the art having the benefit of this disclosure will appreciate, the orientation of the antenna components 103*a*, 103*b* will be depend on design constraints such as the direction in which the subassembly 100 is to radiate energy. Similarly, the orthogonal relationship between the positions of the antenna components 103*a*, 103*b* is an implementation specific detail and may differ in alternative embodiments.

The antenna components 103*a*, 103*b* have a rectangular geometry, which is also an implementation specific detail. In this particular embodiment, the antenna components 103*a*, 103*b* generally resemble "slats" and may be referred to as such. The geometry of the antenna components 103*a*, 103*b* is not material to the practice of the invention. However, in some embodiments, the geometry of the antenna component 103*b* may be chosen to facilitate the placement of the radiating elements 118 to achieve a desired radiation pattern.

In operation, the antenna component 103*a* couples one or more antenna components 103*b* to a power source 124 that drives the antenna component 103*b* to radiate millimeter wave energy in a desired predetermined pattern. Thus, the antenna component 103*a* may be referred to as a "coupling component" and the antenna component 103*b* may be referred to as a "radiating component." Design considerations for the radiating component relative to the pattern of millimeter wave energy it radiates will be discussed further below. As is better illustrated in FIG. 1C-FIG. 1D, the one-bit fixed phase shifters 115 and the couplers 109 are electrically connected their respective traveling wave phase shift lines 112 by coupling structures 127.

Figure 1C:
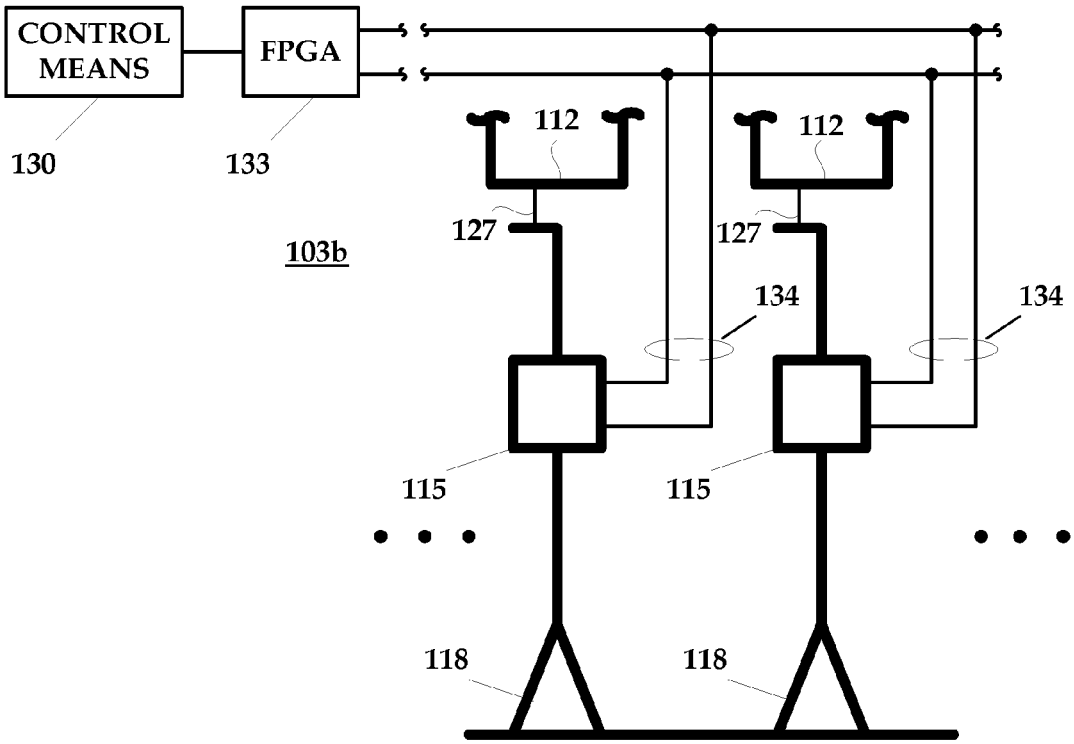
Figure 1D:
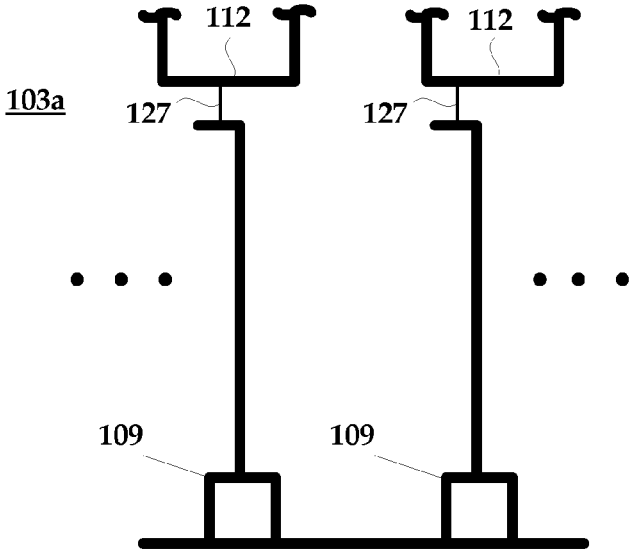

Also, as is shown in FIG. 1C, the operation of the one-bit fixed phase shifters 115 is controlled by a control means 130 over the control lines 134. More particularly, phase control is exerted on one of the control lines 134 and status information is output by the one-bit fixed phase shifter 115 on the other control line 134. Note that the control lines 134 include line drivers and receivers (not shown). The control means 130 may comprise, for instance, a programmable processor (not shown) of some kind program storage medium (not shown) containing the control program for the programmable processor. The control means 130 thereby controls the one-bit fixed phase shifter 115 to steer the grating to control the pattern of the radiated energy. That is, the control means 130 selects the required phase grating pattern to steer the beam. Thus, the one-bit fixed phase shifter 115 of the illustrated embodiment comprises, by way of example and illustration, a means for steering the radiated energy. In operation, the control means 130 outputs a serial data stream to the traveling wave phase shift line 112 of each radiating antenna component 103*b*, the data stream containing the settings for each of the one-bit fixed phase shifters 115 for each of the radiating antenna components 103*b*.

Each radiating antenna component 103*b* includes a means for re-formatting signals 133 that, in the illustrated embodiment, de-multiplexes an input serial data stream into a parallel signal. Typically, the re-formatting means 133 will be implemented as a logic device, but it could also be, for instance, a hard-wired electronic circuit. In the illustrated embodiment, the re-formatting means is a programmable logic device and, more particularly, a field programmable gate array ("FPGA"). The FPGA 133 converts (in parallel) the data stream and generates a switch signal (including inversion, if required) for each one-bit fixed phase shifters 115 of the respective component 103*b*.

Figure 1E:
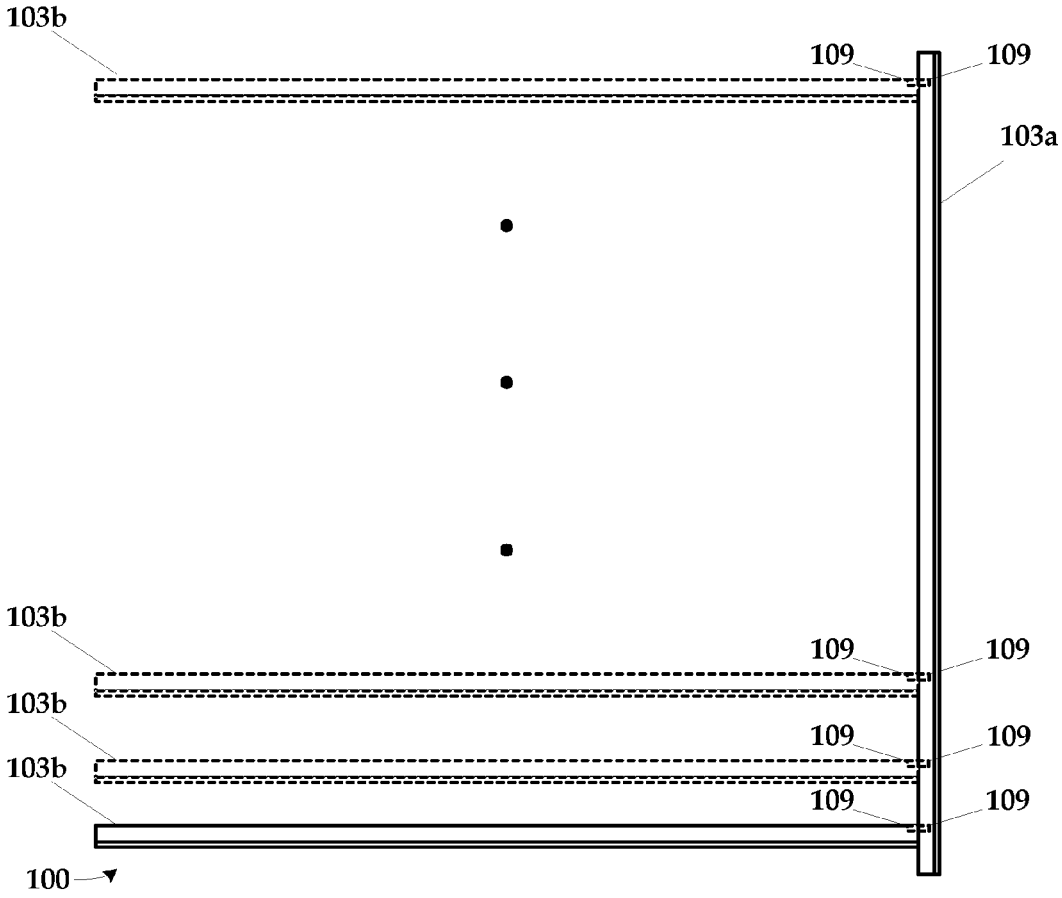
Figure 1F:
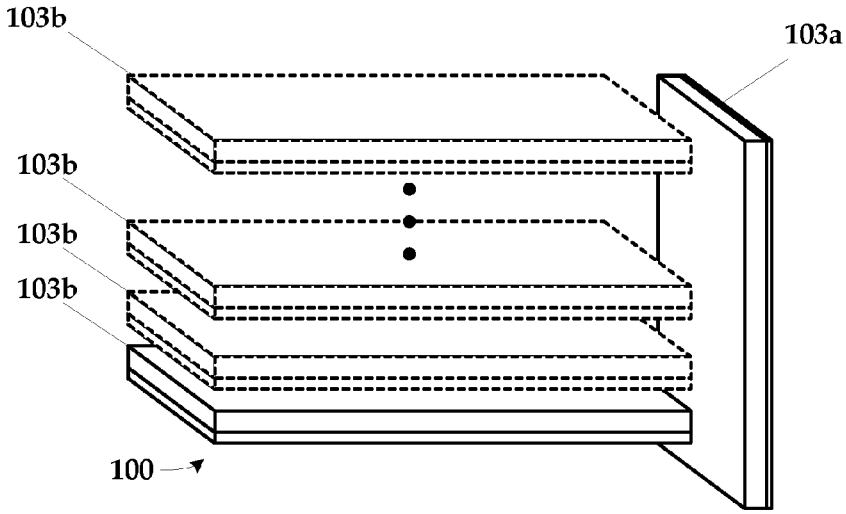

As was noted above, FIG. 1A presents the subassembly 100 in an unassembled view. This view more clearly illustrates the coupling of the antenna components 103*a*, 103*b*. FIG. 1E-FIG. 1F illustrate the subassembly 100 in assembled side, plan and assembled, perspective views, respectively. Note that some details of the antenna components 103*a*, 103*b* are omitted in FIG. 1E-FIG. 1F for the sake of clarity. FIG. 1E-FIG. 1F also show additional antenna components 103*b* in ghosted lines coupled to the antenna component 103*a* to demonstrate how the subassembly 103 can be extrapolated to create a more complex antenna. Note, however, that the subassembly 100 can function as an antenna itself, although the invention contemplates that this will not be the usual case.

The shape, dimensions, etc. of the traveling wave phase shift line 112 are determined by the desired traveling wave phase shift for the antenna being implemented. Thus, this aspect of the present invention will be implementation specific. Note that the traveling wave phase shift line 112 can be implemented using a meander line or a slow wave structure in alternative embodiments. Thus, the traveling wave phase shift line 112 of the illustrated embodiment is, by way of example and illustration, but one means for feeding the radiating elements 118. The illustrated embodiment employs a slow-wave structure in microstrip.

Figure 2:
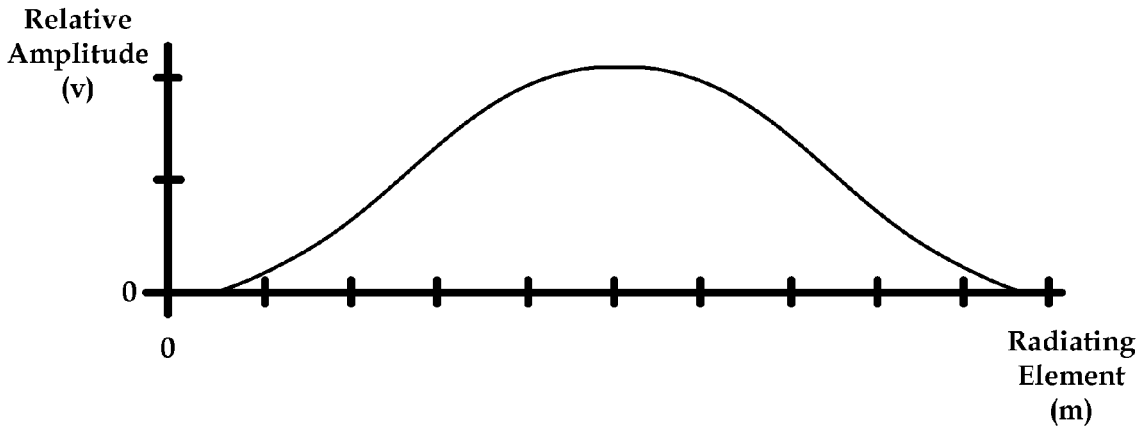
FIG. 2-FIG. 4 illustrate the amplitude weighting function in the grating beam steering, the traveling wave phase shift function, and the grating pattern phase modulation, respectively, of the embodiment in FIG. 1A-FIG. 1F.

The aperture element distribution ("$AE_m$"), i.e., the distribution of the radiating elements 118, can be determined by Eq. (1):

$$AE_m = (AW_m)^{1/2}\exp\left[\frac{i2\prod x_m}{\lambda/n} + i\prod G_m\right] \quad \text{Eq. (1)}$$

where:

m≡the element number $AW_m$≡the amplitude weighting, shown in FIG. 2 for the illustrated embodiment, which will be a function of the antenna design (e.g., side lobe level requirement) and tends to suppress side lobes;

$x_m$≡the physical distance between each radiating element 118, which is constant, or uniform, in the illustrated embodiment;

λ≡the free space wavelength;

n≡the propagation constant (nominally 1.5 for the illustrated embodiment, but can be tailored by the design goals); and $G_m$≡the bi-phase steering modulation function.

Figure 3:
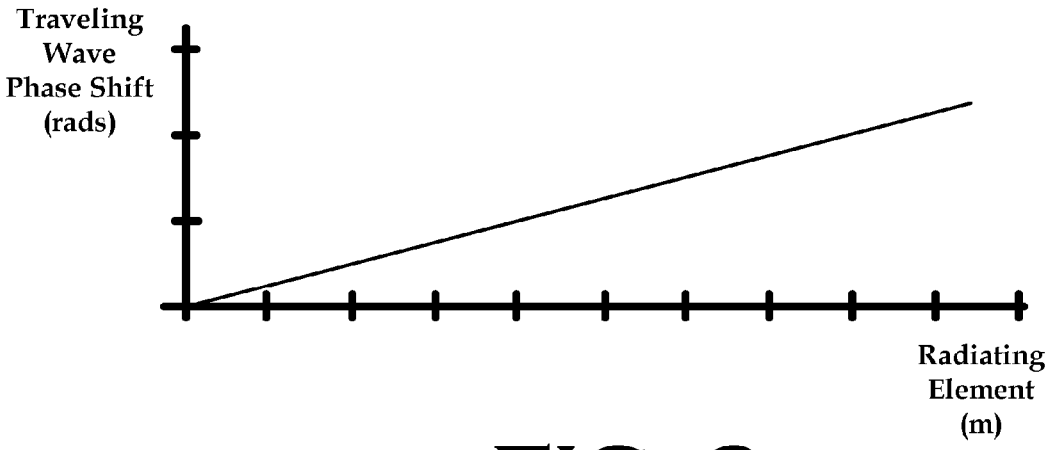
Figure 4:
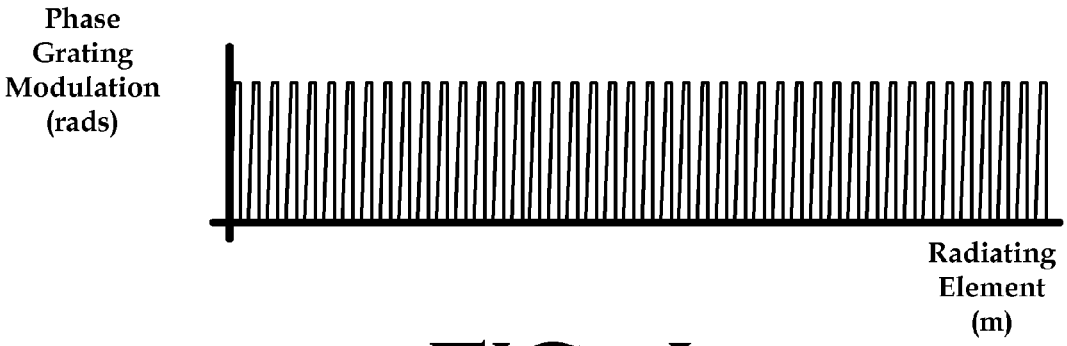

Note that, in Eq. (1), the factor Π/(λ/n) is the traveling wave phase shift function, shown in FIG. 3 for the illustrated embodiment, and the factor $i\Pi G_m$ represents the grating pattern phase modulation, shown in FIG. 4 for illustrated embodiment. The steering modulation (a/k/a grating) period ("Λ") is represented by Eq. (2):

$$\Lambda = \frac{\lambda}{n - \sin\varphi} \quad \text{Eq. (2)}$$

where:

λ≡the free space wavelength;

n≡the propagation constant (nominally 1.5 for the illustrated embodiment, but can be tailored by the design goals); and ϕ≡the scanning angle.

The modulation sinusoid ("$g_m$") is represented by Eq. (3):

$$g_m = \sin\left[\frac{2\prod x_m}{\Lambda}\right] \quad \text{Eq. (3)}$$

where:

m≡the element number;

$x_m$≡the element spacing, as defined above; and

Λ≡the steering modulation period, as defined above.

Thus, the grating function ("$G_m$") can be represented as:

$$G_m = \text{if}(g_m > 0, 1, 0) \quad \text{Eq. (4)}$$

where:

m≡the element number; and $g_m$≡modulation sinusoid, as defined above.

Consequently, $G_m$=1 if $g_m$>0 and $G_m$=0 otherwise. The grating function is therefore an on/off toggle.

The above equations are general solutions for phase grating modulation. Phase grating is known to the art. Phase grating techniques suitable for use in one or more embodiments of the present invention are disclosed in:

- U.S. Pat. No. 6,313,803, entitled "Monolithic Millimeter-Wave Beam-Steering Antenna", issued Nov. 6, 2001, to Waveband Corp. as assigned of the inventors Vladimir Manasson et al.;
- U.S. Pat. No. 6,211,836, entitled "Scanning Antenna Including a Dielectric Waveguide and a Rotatable Cylinder Coupled Thereto", issued Apr. 3, 2001, to Waveband Corp. as assigned of the inventors Vladimir Manasson et al.;
- U.S. Pat. No. 5,982,334, entitled "Antenna with Plasma-Grating", issued Nov. 9, 1999, to Waveband Corp. as assigned of the inventors Vladimir Manasson et al.;
- U.S. Pat. No. 5,959,589, entitled "Remote Fire Detection Method and Implementation Thereof", issued Sep. 28, 1999, to Waveband Corp. as assigned of the inventors Lev Sadovnik, et al.;
- U.S. Pat. No. 5,933,120, entitled "2-D Scanning Antenna and Method for the Utilization Thereof", issued Aug. 3, 1999, to Waveband Corp. as assigned of the inventors Vladimir Manasson et al.;
- U.S. Pat. No. 5,886,670, entitled "Antenna and Method for Utilization Thereof", issued Mar. 23, 1999, to Waveband Corp. as assigned of the inventors Vladimir Manasson et al.;
- U.S. Pat. No. 5,815,124, entitled "Evanescent Coupling Antenna and Method for Use Therewith", issued Sep. 29, 1998, to Waveband Corp. as assigned of the inventors Vladimir Manasson et al.;
- U.S. Pat. No. 5,796,881, entitled "Lightweight Antenna and Method for the Utilization Thereof", issued Aug. 18, 1998, to Waveband Corp. as assigned of the inventors Vladimir Manasson et al.;
- U.S. Pat. No. 5,694,498, entitled "Optically Controlled Phase Shifter and Phased Array Antenna for Use Therewith", issued Dec. 2, 1997, to Waveband Corp. as assigned of the inventors Vladimir Manasson et al.;
- U.S. Pat. No. 5,572,228, entitled "Evanescent Coupling Antenna and Method for the Utilization Thereof" , issued Nov. 5, 1996, to Physical Optics Corporation as assigned of the inventors Vladimir Manasson et al.;
- U.S. Pat. No. 5,305,123, entitled "Light Controlled Spatial and Angular Electromagnetic Wave Modulator", issued Apr. 19, 1994, to Physical Optics Corporation as assigned of the inventors Lev Sadovnik, et al.;

However, note that structural implementations in these patents differ remarkably. Furthermore, other phase grating techniques may also be employed.

Figure 5A:
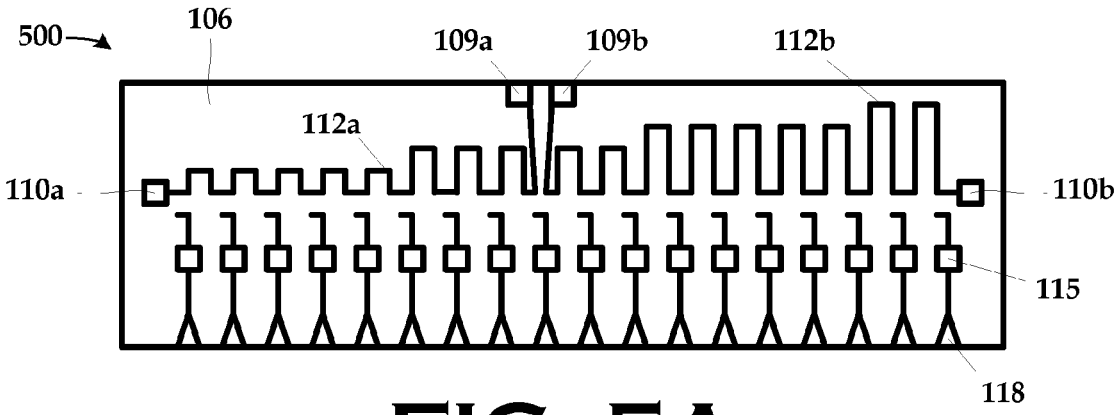
FIG. 5A-FIG. 5E illustrate a second subassembly alternative to that shown in FIG. 1A-FIG. 1F.

FIG. 5A-FIG. 5E depict an embodiment alternative to that shown in FIG. 1A-FIG. 1F. FIG. 5A illustrates a radiating antenna component 500, which is an alternative embodiment for the antenna component 103*b* of FIG. 1A. The antenna component 500 includes, like the antenna component 103*b*, a plurality of radiating elements 118 (only one indicated) fabricated in the substrate 106 and electromagnetically connected to a respective one-bit fixed phase shifter 115 (only one indicated). In this embodiment, too, the radiating elements 118 are uniformly distributed. However, the antenna component 500 includes two traveling wave phase shift lines 112*a*, 112*b*, two couplers 109*a*, 109*b*, and two interconnects 110*a*, 110*b*.

Figure 5B:
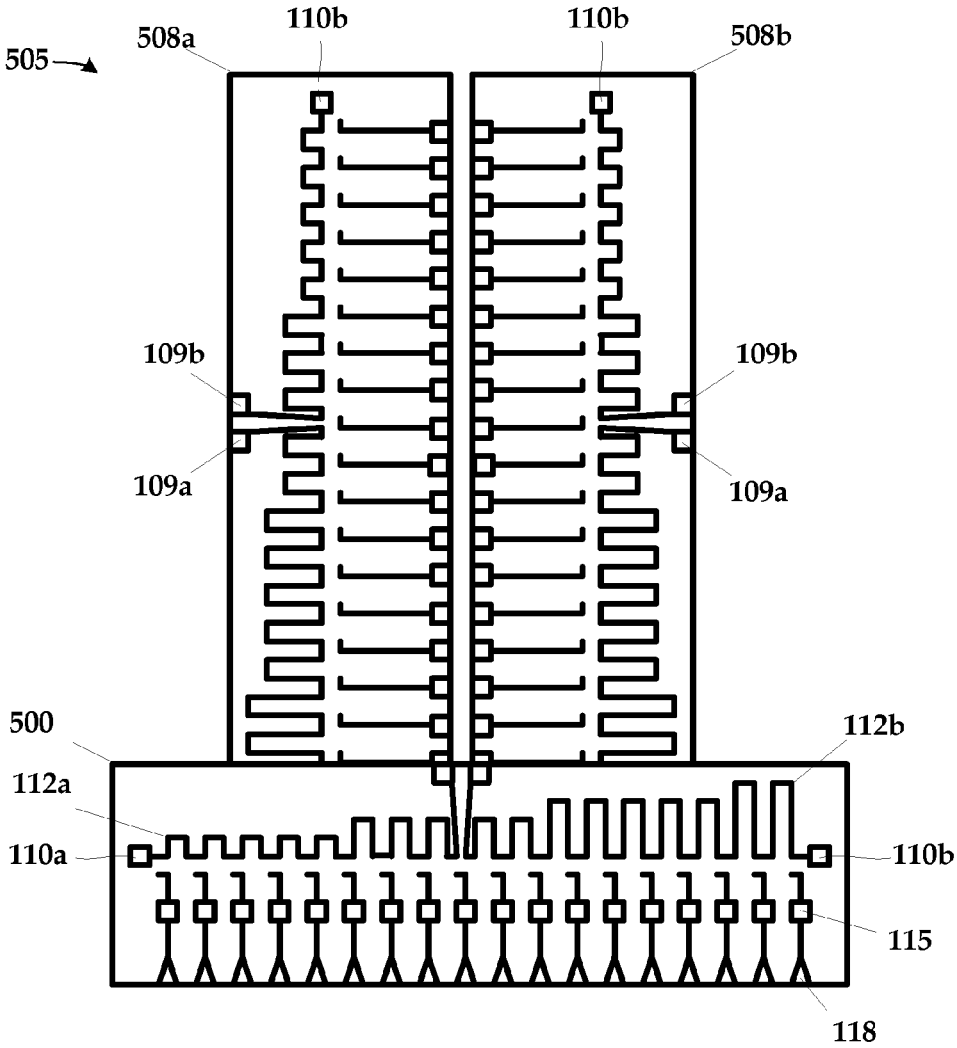
Figure 5C:
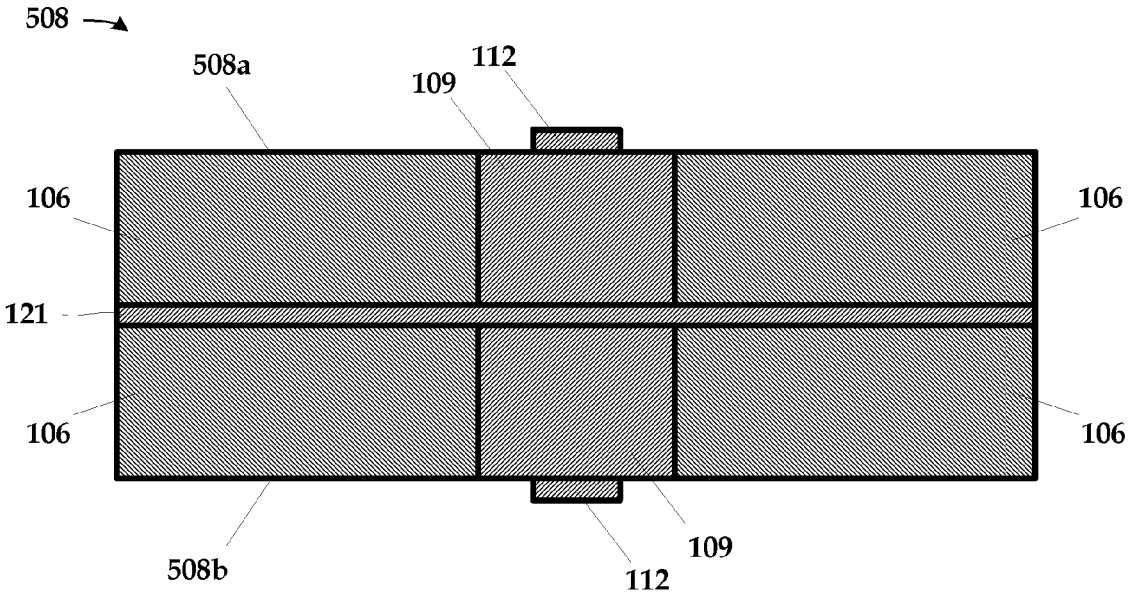

FIG. 5B illustrates a subassembly 505 comprising the radiating antenna component 500 and a coupling antenna component 508. As is best shown in FIG. 5C, the coupling antenna component 508 includes two faces 508*a*, 508*b*. Each face 508*a*, 508*b* is fabricated on a respective substrate 106, the substrates 106 sandwiching a ground plane 121 between them. Each face 508*a*, 508*b* of the coupling antenna component 508 also includes two traveling wave phase shift lines 112*a*, 112*b*, two couplers 109*a*, 109*b*, and two interconnects 110*a*, 110*b*. Note that the interconnect 110*a* for each antenna component 508 is hidden behind the antenna component 500 in FIG. 5B.

Figure 5D:
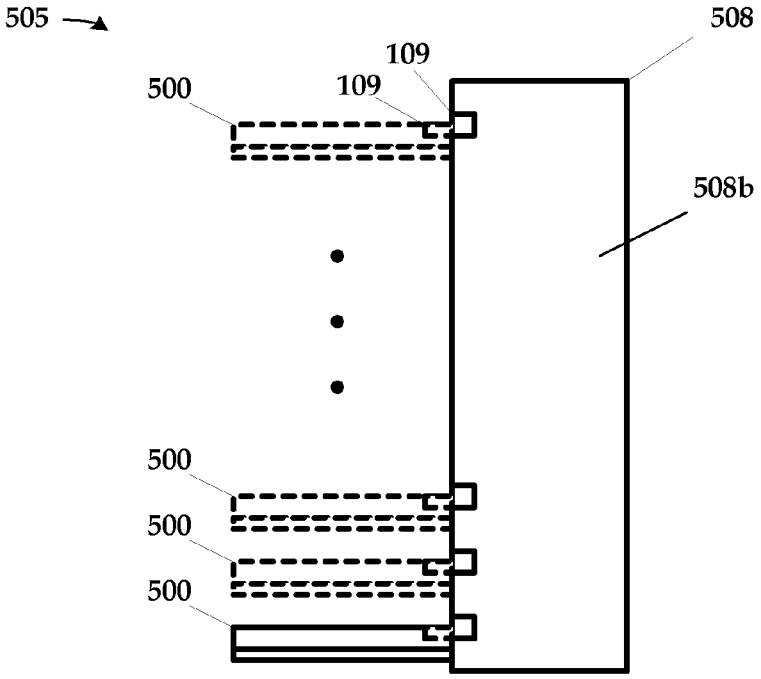
Figure 5E:
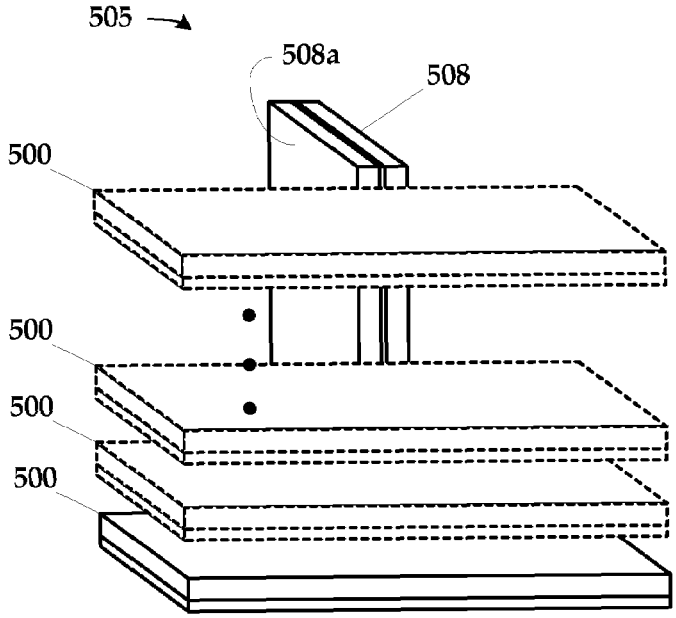

FIG. 5D-FIG. 5E illustrate the subassembly 505 in assembled side, plan and assembled, perspective views, respectively. Note that some details of the antenna components 500, 508 are omitted in FIG. 5D-FIG. 5E for the sake of clarity. Note also that not all the couplers 109 shown in FIG. 5D are identified. FIG. 5D-FIG. 5E also show additional antenna components 500 in ghosted lines coupled to the antenna component 508 to demonstrate how the subassembly 505 can be extrapolated to create a more complex antenna. However, the subassembly 505 can function as an antenna itself, although the invention contemplates that this will not be the usual case.

As is apparent from comparing FIG. 1A-FIG. 1F and FIG. 5A-FIG. 5E, various coupling configurations are contemplated. The arrangement of coupler(s) 109, traveling wave phase shift line(s) 112, radiating elements 118 (and concomitant one-bit fixed phase shifters 115) can be adapted to permit these and other alternative coupling configurations. Similarly, the use of one or two sides of the various components may also permit alternative coupling configurations. For instance, FIG. 6-FIG. 7 depict two alternative subassemblies 600, 700 employing alternative coupling configurations.

Figure 6:
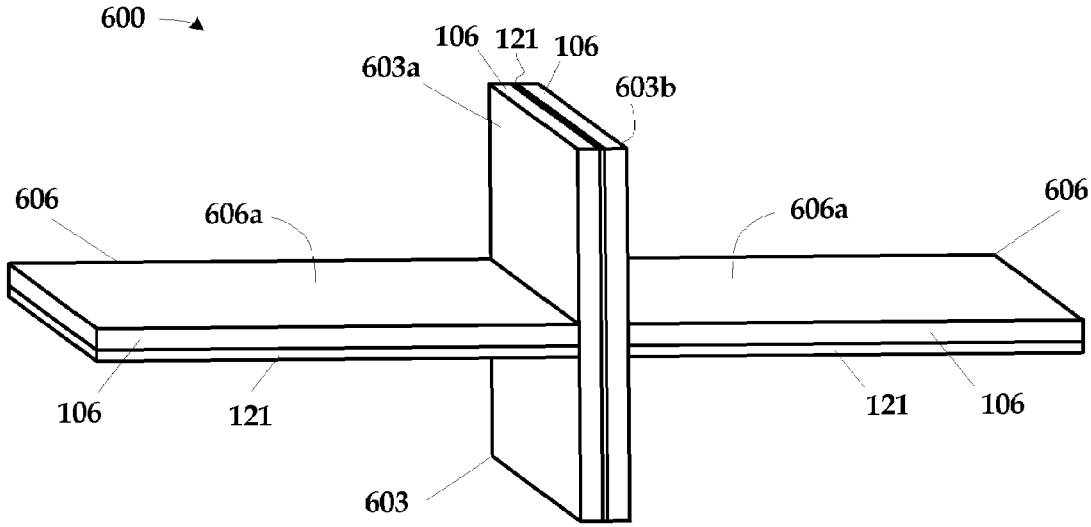
FIG. 6-FIG. 7 illustrate alternative coupling configurations in accordance with the present invention.

In FIG. 6, the coupling antenna component 603 is of a two-sided construction in the manner of the coupling antenna component 508, best shown in FIG. 5E. Thus, the coupling antenna component 603 includes two faces 603*a*, 603*b*, each fabricated on a respective substrate 106. The substrates 116 sandwich a ground plane 121. Each radiating antenna component 606 includes only a single face 606*a* fabricated on side of a substrate 106 with a ground plane 121 on the obverse side of the substrate 106 in the manner of the radiating components 103*b*, 500, shown best in FIG. 1E-FIG. 1F and FIG. 5D-FIG. 5E, respectively. However, the couplers 109 (not shown) will be moved relative to the first two embodiments to facilitate the coupling configuration shown.

Figure 7:
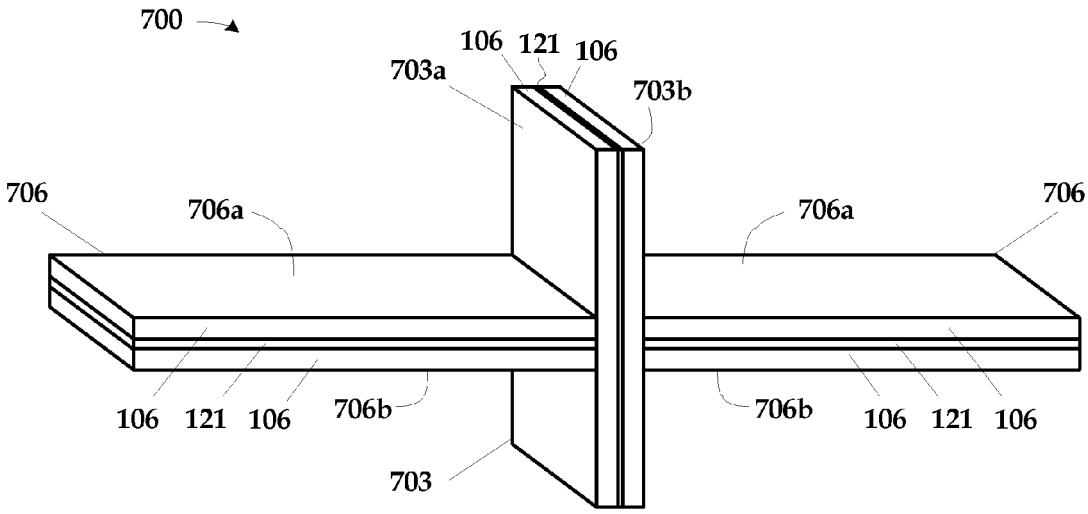

In FIG. 7, the coupling antenna component 703 is also of a two-sided construction in the manner of the coupling antenna component 508, best shown in FIG. 5E. Thus, the coupling antenna component 703 includes two faces 703*a*, 703*b* fabricated on substrates 106 sandwiching a ground plane 121. However, the radiating antenna components 706 also exhibit the two-sided construction and therefore also include two faces 706*a*, 706*b* fabricated on substrates 106 sandwiching a ground plane 121. Again, the couplers 109 (not shown) will be moved relative to the first two embodiments to facilitate the coupling configuration shown.

Figure 8:
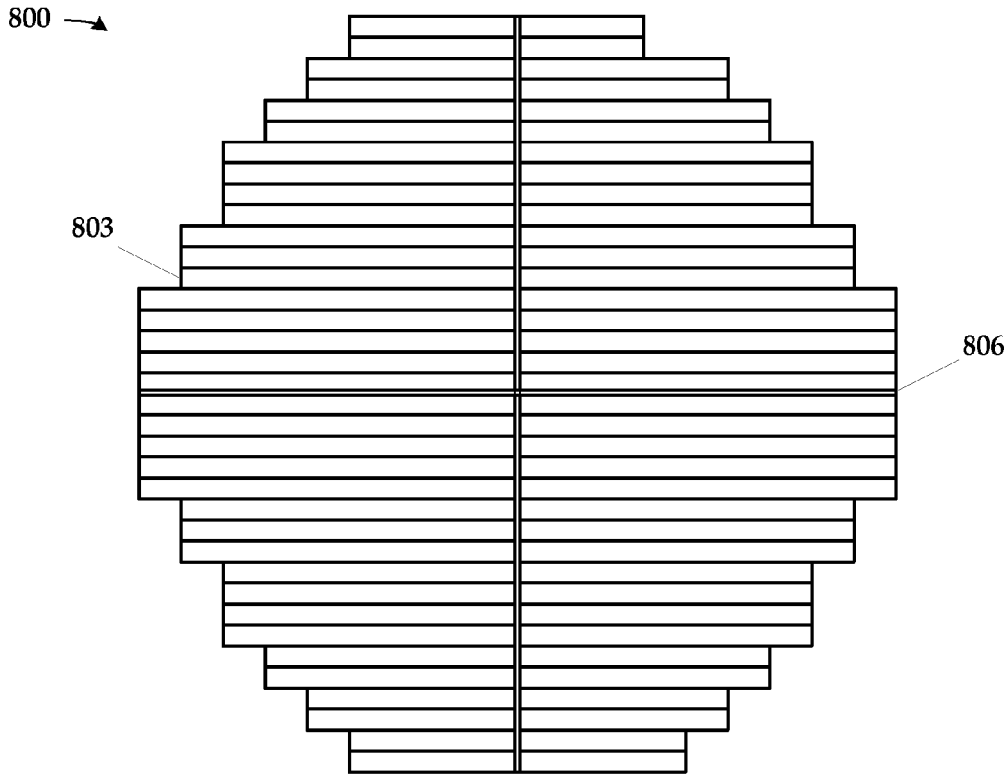
FIG. 8 illustrates an antenna constructed in accordance with the present invention.

FIG. 8 illustrates an antenna 800 extrapolating from the one or more of the subassemblies 100 shown in FIG. 1A-FIG. 1F, for instance. The antenna 800 is shown in a top, plan view. The antenna 800 comprises multiple radiating antenna components 803 (only one indicated) of varying sizes coupled to one or more coupling antenna components 806 (only one indicated) as described above. The coupling may be maintained by affixing the components 803, 806 to one another using, for example, fasteners such as guide pins, or any other suitable technique that may be apparent to those skilled in the art having the benefit of this disclosure. Note that the antenna 800 is configured to provide quadrants, but could be configured in any suitable topology including sum only, or standard monopulse configurations.

Simulation has demonstrated the operability and efficacy of the present invention. One session simulated an antenna (not shown) operating at 35 GHz±2.5% with a signal loss >4 dB. The element spacing $x_m$ for ~24,500 radiating elements 118 was 0.034" (i.e., $1/10^{th}$ of the wavelength $\lambda$) and the radiating elements 118 were arranged in a rectangular lattice. The simulation contemplated a 25 dB Taylor weighting and 10 μs switching time. The simulated design included 4, ~8 mil layers fabricated from a low loss microwave substrate (e.g., Rogers RO3003). The traveling wave phase shift line 112 was positioned on the back of the antenna components and implemented as a stripline circuit with a ground plane spacing of 32 mils. The couplers 109 were also stripline circuits with a 16 mil ground spacing.

Typically, the individual antenna components of most embodiments will actually be multi-layered structures. Consider, for instance, a radiating antenna component 900, a portion of which is shown in cross-section in FIG. 9. The radiating antenna component 900 comprises four layers 903*a*-903*d* fabricated from Rogers RO3003 DUROID. The layers 903*a*, 903*d* are approximately 0.005" thick. The layers 903*b*, 903*c* are approximately 0.010" thick. The layers 903*a*-903*d* are fusion bonded together using techniques known to the art. The layers 903*a*, 903*d* form "lids" that cap the structure.

The one-bit fixed phase shifters 906 are MMICs and are epoxied or soldered to the layers 903*b*, 903*c* in blind cavities 909 milled in the layers 903*b*, 903*c*. Corresponding blind cavities 912 are also milled on the opposing layers 903*a*, 903*d*. Signal lines 915*a*-915*c* are sandwiched between the layers 903*a*-903*d* and ground planes 918*a*, 918*b* sandwich the four layers 903*a*-903*d*. The signal lines 903*a*, 903*c* are control lines to the one-bit fixed phase shifters 906. The signal line 903*b* is the traveling wave phase shift line. The signal line 903*b* and the one-bit fixed phase shifters 906 are capacitively coupled through the portions 921 of the layers 903*b*, 903*c* therebetween. Electrical connections (e.g., the one-bit fixed phase shifters 906 to the signal lines 915*a*-915*c*) are made using flip-chip or wire bond techniques as are known in the art.

Such an embodiment may be assembled by first fabricating two 2-layer circuits using the aforementioned microstrip fabrication technologies. This includes fabricating the traveling wave phase shift lines 112 and radiating elements 118 for each layer of each circuit in the substrate 106 and then laminating them. The one-bit fixed phase shifters 115 and control elements (i.e., the control means 130/FGPA 133) are then added to the laminated two-layer circuits. Note that, in this particular embodiment, each two-layer circuit includes only every other one-bit fixed phase shifters 115 for spacing considerations. The two-layer circuits are then laminated together to encapsulate and protect the one-bit fixed phase shifters 115 and control elements.

Figure 10C:
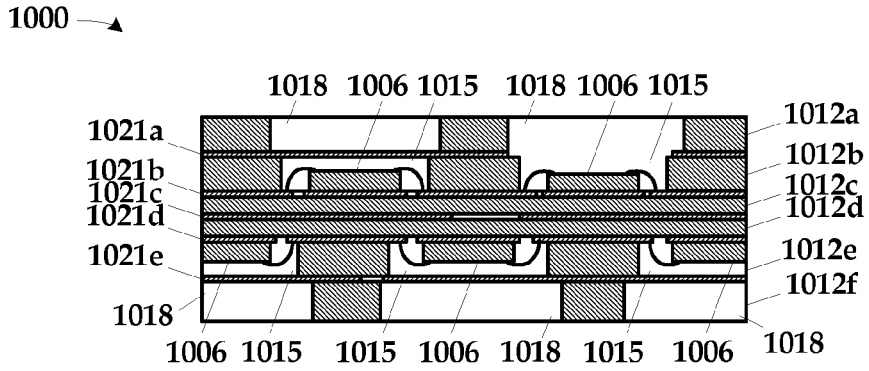
FIG. 10A-FIG. 10G illustrate a second multi-layer radiating antenna component and, more particularly.
Figure 10A:
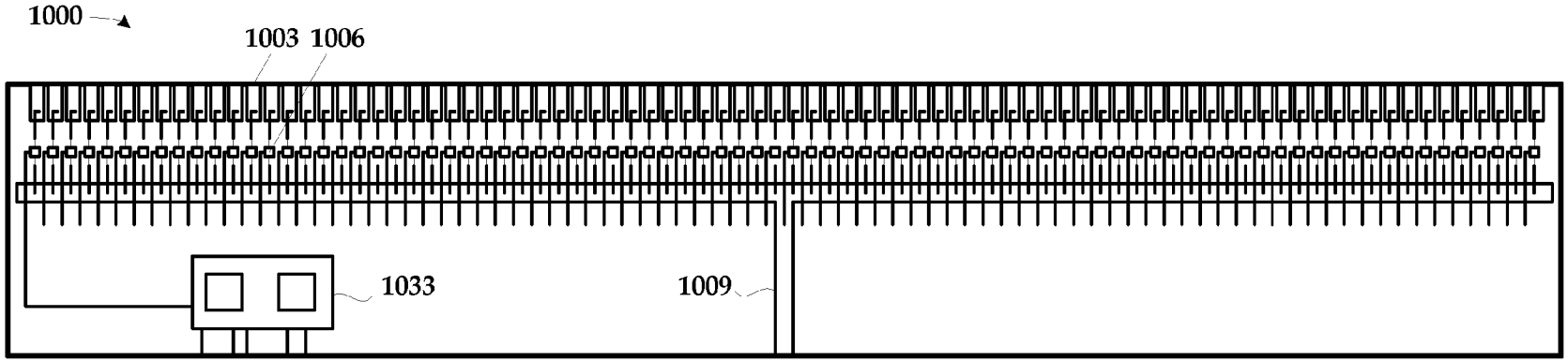
Figure 10B:
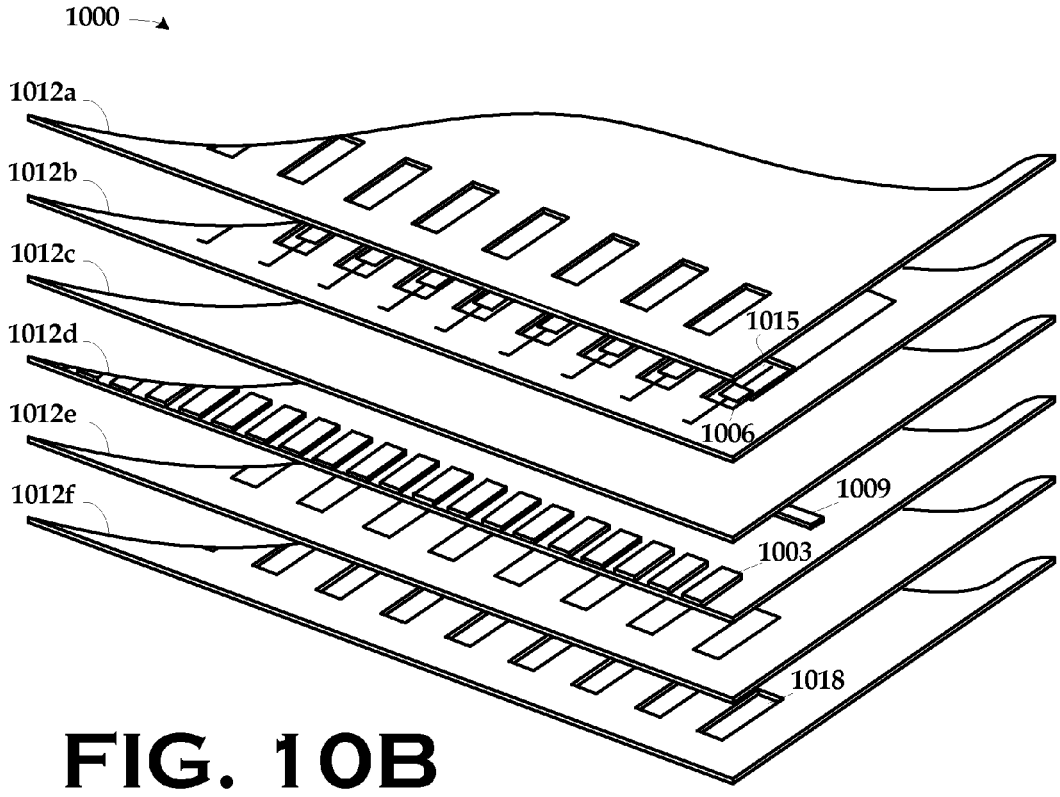
Figure 10D:
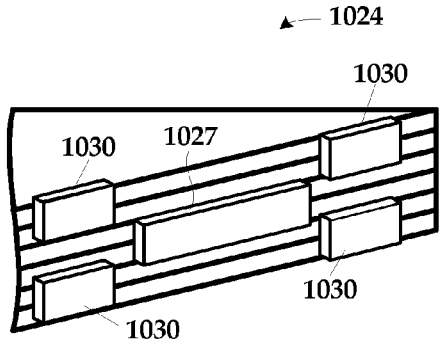
Figure 10E:
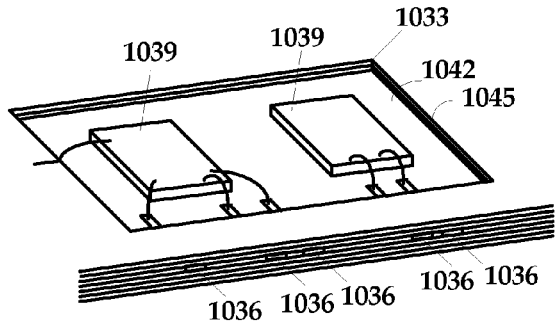
Figure 10F:
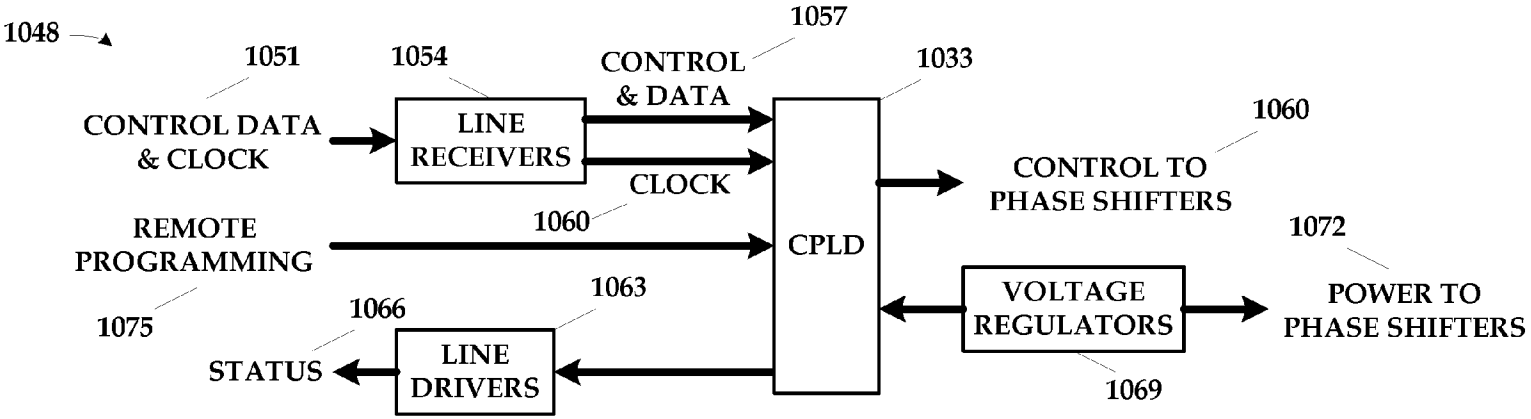
Figure 10G:
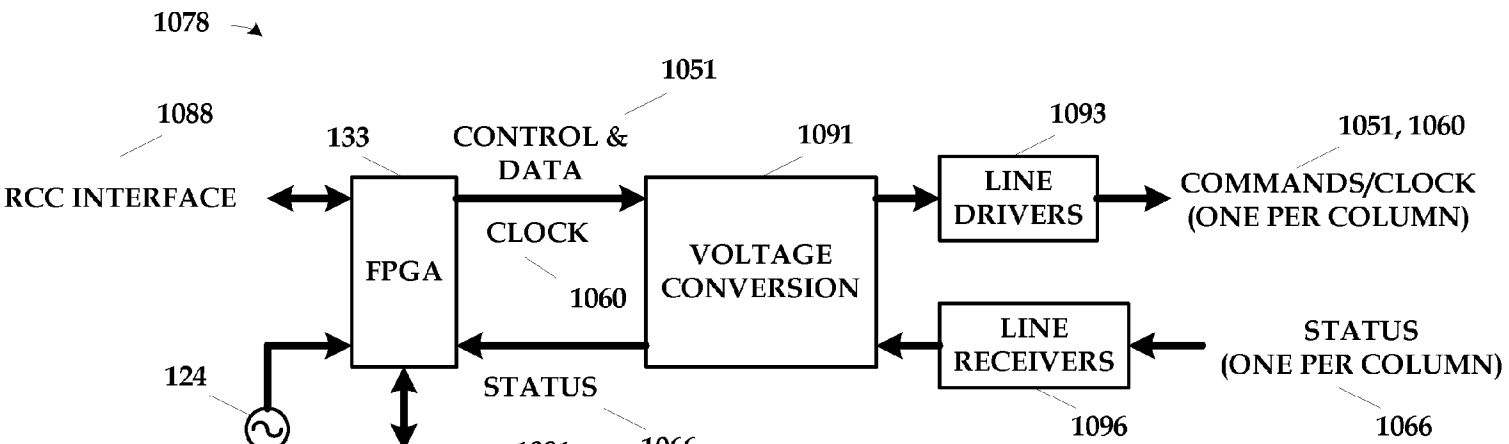

FIG. 10A-FIG. 10G illustrate a second multi-layer radiating antenna component 1000. More particularly:

FIG. 10A is a conceptualization of the functional interrelationships of the various parts of the radiating antenna component 1000;

FIG. 10B is an exploded, perspective view of a portion of the radiating antenna component 1000 illustrating the six layers thereof;

FIG. 10C is a cross-section of a portion of the radiating antenna component 1000;

FIG. 10D illustrates edge connectors for radio frequency ("RF") signals input to the radiating antenna component 1000;

FIG. 10E illustrates the control elements of the radiating antenna component 1000; and FIG. 10F-FIG. 10G illustrates functionality the control elements of the radiating antenna component 1000, first shown in FIG. 10E, and of a coupling antenna component with which the radiating antenna component 1000 may be used.

Figure 11C:
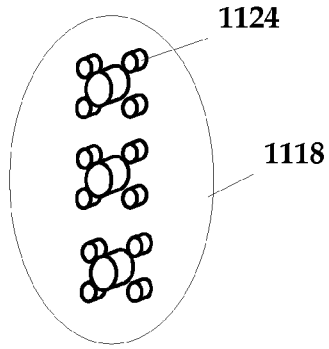
FIG. 11A-FIG. 11C illustrate an antenna constructed from a plurality of radiating antenna components such as the one illustrated in FIG. 10A-FIG. 10G.
Figure 11A:
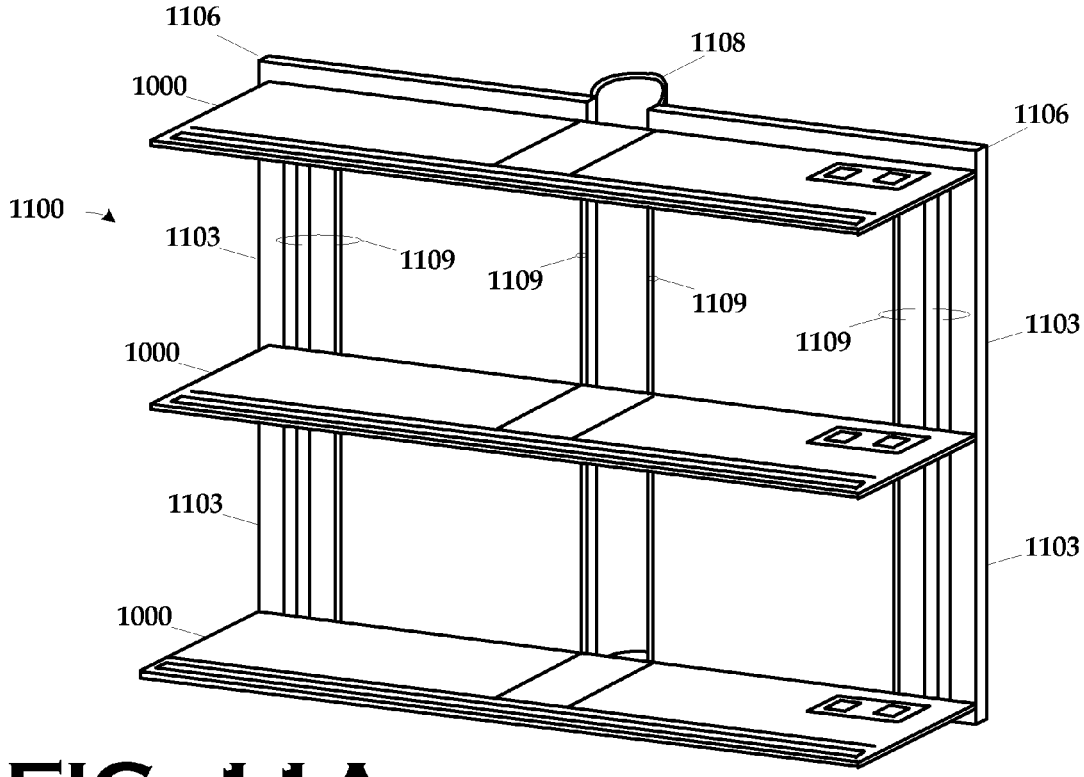
Figure 11B:
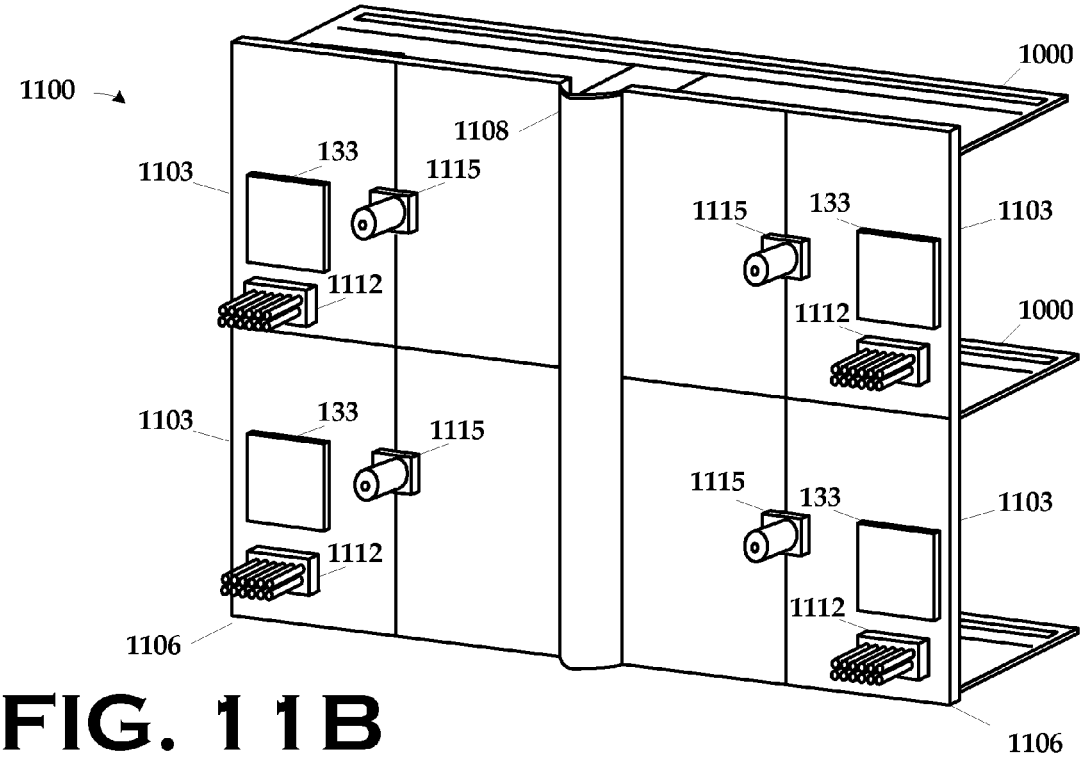

FIG. 11A-FIG. 11B subsequently illustrate an antenna 1100 constructed from a plurality of radiating antenna components 1000.

Referring now to FIG. 10A, like the embodiments previously discussed, the radiating antenna component comprises a plurality of radiating elements 1003 (only one indicated), a plurality of one-bit fixed phase shifter 1006 (only one indicated), and a traveling wave phase shift line 1009 that interact and function as described above. Note that the traveling wave phase shift lines in previous embodiments (e.g., the traveling wave phase shift lines 112 in FIG. 1A) are meander lines. However, other microstrip slow wave structures are possible with the selection of the circuit dimensions and material properties. For instance, the traveling wave phase shift line 1009 is a straight microstrip line that achieves the same purpose. Thus, the traveling wave phase shift line 1009 is, by way of example and illustration, is a second means for feeding the radiating elements 118 alternative to that previously shown.

Figure 9:
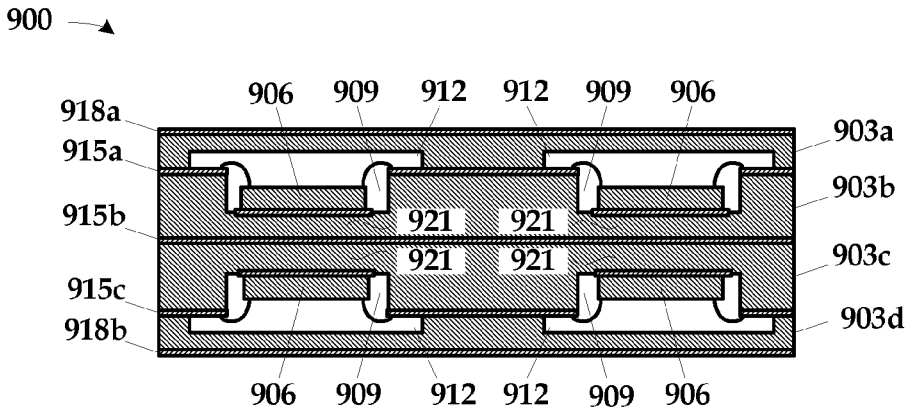
FIG. 9 illustrates a multi-layered structure for use in implementing a radiating antenna component.

The structure of the radiating antenna component is a six-layered structure whose design differs from the design of the radiating antenna component 900, shown in FIG. 9. FIG. 10B is an exploded, perspective view of a portion of the radiating antenna component 1000 illustrating the six layers 1012*a*-1012*f* thereof. FIG. 10C is a cross-section of a portion of the radiating antenna component 1000.

The one-bit fixed phase shifters 1006 are MMICs and are epoxied or soldered to the layers 1012*b*, 1012*e* in blind cavities 1015 milled therein. However, the corresponding cavities 1018 in the layers 1012*a*, 1012*f* are through cavities, as opposed to blind cavities. Note, also, that the one-bit fixed phase shifters 1006 are alternated on the layers 1012*b*, 1012*e*. The one-bit fixed phase shifters 1006 are capacitively coupled to the radiating elements 1003 and the traveling wave phase shift line 1009 through the respective layers 1012*c*, 1012*d*.

Referring to FIG. 10B, the structure of the radiating antenna component 1000 also includes a plurality of signal lines 1021*a*-1021*e*. The signal lines 1021*a*, 1021*e* are stripline ground planes. The signal lines 1021*b*, 1021*d* include phase control, broadside radio frequency ("RF") couplers, and element feed lines, discussed further below. The signal line 1021*c* includes the radiating elements 1003 and the traveling wave phase shift line 1009, also shown in FIG. 10A, FIG. 10C.

Returning to FIG. 10A, details regarding the multi-layer construction of the radiating antenna component 1000 shown in FIG. 10B-FIG. 10C have been omitted from the conceptualization to more clearly illustrate the functional relationships. Thus, the radiating elements 1003 and the traveling wave phase shift line 1009 shown in FIG. 10A are actually fabricated between the layers 1012*c*, 1012*d*, as also shown in FIG. 10B-FIG. 10C. Similarly, the one-bit fixed phase shifters 1006 are actually affixed in the blind cavities 1015 in the layers 1012*b*, 1012*d*, also as shown in FIG. 10B-FIG. 10C.

As was mentioned above, the signal lines 1021*b*, 1021*d*, shown in FIG. 10B, includes phase control and broadside RF couplers. These elements are shown more clearly in FIG. 10D-FIG. 10E. In particular, the RF connection is made through a pseudo-coax arrangement 1024 shown in FIG. 10D comprising a RF feed 1027 and multiple stripline ground planed connections 1030. The control function performed by the FPGA 133, shown in FIG. 1C, is performed by a complex programmable logic device ("CPLD") 1033 shown in FIG. 10A. The CPLD 1033 receives the control signals from a controlling means, e.g., the control means 130 shown in FIG. 1C, via a plurality of edge connectors 1036 shown in FIG. 10E. Thus, the edge connectors 1036 are "couplers" and are but one exemplary means for coupling the antenna component 1000 to various signal sources. In this particular embodiment, the CPLD 1033 receives through the edge connectors 1036 a +3.3V, Clk+, Clk−, serial data stream (phase control) signals and transmits a status signal. Note that the devices 1039 of the CPLD 1033 are positioned in a blind cavity 1042 of a layer with a through cavity 1045 in the layer above.

The control system 1048 for the radiating antenna component 1000 is illustrated in FIG. 10F. The CPLD 1033 receives control, data, and clock signal(s) 1051 through a plurality of line receivers 1054, which separates the control, data, and a clock signals 1051 into separate control and data signals 1057 and a clock signal 1060. The CPLD 1033, in response, outputs control signals 1060 to the one-bit fixed phase shifter 1006. The control signals 1060 may include, for example, phase data, phase load strobe, and control voltage information. The CPLD 1033 also outputs via a plurality of line drivers 1063 one or more status signals 1066. The status signals 1066 may include, for example, voltages and valid stimulation indicators.

The control system 1048 also include a plurality of voltage regulators 1069 that provide power 1072 to the CPLD 1033 and to the one-bit fixed phase shifter 1006. The CPLD 1033 may also be remotely programmed by one or more remote program signal(s) 1075 should there be a desire to change the grating pattern. The control, data, and a clock signal 1051, status signal(s) 1066, and remote programming signal 1075 are input and output over the edge connectors 1036 shown in FIG. 10E. Note that the functionality of the control system 1048 can be removed from radiating antenna component 1000 in other embodiments. In these embodiments, the control system 1049 can be relocated to, for instance a coupling antenna component (not shown) associated with the radiating antenna component 1000. The control system 1049 might also be removed to some other part of the antenna (not shown) into which the radiating antenna component is assembled.

The control system 1078 for a coupling antenna component (not shown) in this embodiment is shown in FIG. 10F. An FPGA 133 receives control data 1051 from a radar control computer ("RCC") interface 1088, e.g., the control means 130 in FIG. 1C, and a clock signal from an oscillator 124. Among the signals received from the RCC interface 1088 may be, for instance, timing signals (e.g., dwell start, re-steer, transmit/receive gate, and reset), stimulus signals, and command signals. The FPGA 133 is programmed from a configurable programmable, read only memory ("PROM") 1081. The FPGA 133 transmits the control data 1051 and the clock signal 1060 to the control system 1048, shown in FIG. 10F, in parallel via a voltage conversion 1091 and a plurality of line drivers 1093. The FPGA 133 also receives the status information 1066 in parallel from the control system 1048 through a plurality of line receivers 1096 and the voltage conversion 1091 and passes it on to the RCC interface 1088. As with the control system 1048, the functionality of the control system 1078 can be removed from the coupling antenna component to, for example, some other part of the antenna (not shown) into which the coupling antenna component is assembled.

FIG. 11A-FIG. 11B illustrate an antenna 1100 constructed from a plurality of radiating antenna components 1000 (only three shown) and coupling antenna components 1103. The coupling antenna components 1103 form two four-quadrant backplanes 1106 with independent transmit/receive capabilities joined by a flexible ribbon connector 1108. Each backplane 1106 includes multiple signal distribution lines 1109 on one side, and DC control signal headers 1112, RF feeds 1115, and FPGAs 133 on the other. FIG. 11C illustrates a portion 1118 of a signal distribution line 1109 through which ground and RF connections are made to the radiating antenna components 1000. This particular signal distribution line 109 comprises a plurality of pseudo-coaxial connections 1121 that mate to the connections 1024, shown in FIG. 10D, of the individual antenna components 1000. The connections 1121 may comprise, for example, a plurality of spring-loaded detents 1124 (only one shown). Note, however, that other techniques may be employed. Note that the assembly cabinet for the antenna 1100 is not shown for the sake of clarity. Also, to obtain the desired vertical spacing between the radiating elements 1003, shims (not shown) may be employed between individual radiating antenna components.

Thus, in operation, an RCC generates a plurality of timing and control signals that are output to the control system 1078, shown in FIG. 10G. The control system 1078 distributes these signals as described above through the signal headers 1112, shown in FIG. 11B and the signal distribution lines 1109, shown in FIG. 11A. The RF signal is fed through the RF feeds 1115, shown in FIG. 11B, and the distribution lines 1109, shown in FIG. 11A. Referring now to FIG. 10A, the RF signal propagates to the radiating elements 1103 over the traveling wave phase shift line 1009. The CPLD 1033 of the control system 1048, shown more fully in FIG. 10F, relays the control signals as described above that control the operation of the one-bit fixed phase shifters 1006 to steer the radiating energy, also as described above.

Figure 12:
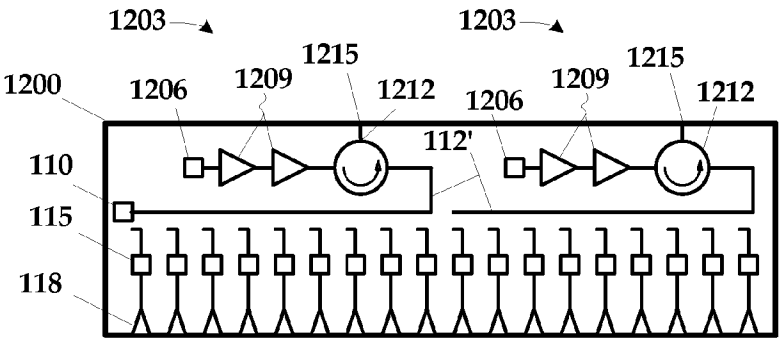
FIG. 12 is a conceptualization of the functional inter-relationships of the various parts of a radiating antenna component in an embodiment in which the antenna component is active and contains active components.

The approach implemented in the passive embodiments disclosed above can be modified to an "active" configuration that does not require conventional transmit/receive ("T/R") modules. The approach achieves a very high level of integration that reduces both cost and risk moving toward a wafer level integrated active antenna. The active antenna concept would use amplifiers at each quadrant input feeding the slat combined with a conventional receive configuration as shown in FIG. 12. The active dense microstrip approach provides many additional benefits and eliminates the need for a conventional T/R module.

More particularly, FIG. 12 illustrates an active antenna component 1200 that can be used in both transmit and receive modes. The active antenna component 1200 includes at least one active circuit 1203. In the illustrated embodiment, the antenna component 1200 is used in an quad configured antenna, and so the antenna component 1200 includes two circuits 1203, each one controlling a respective half of the antenna component 1200. The number of circuits 1203 will be implementation specific and is not material to the practice of the invention.

Each active circuit 1203 comprises a tuning circuit 1206, a pair of MMIC amplifiers 1209, and a circulator 1212. In the transmit mode, the antenna component 1200 receives the signal to transmit over the connection 1215 and directs it through the MMIC amplifiers 1209, which boost the signal, to the tuning circuit 1206. The tuning circuits 1206 for each antenna component 1203 operate to balance the gain and phase of the power amplifiers 1209. Note that some embodiments may be sufficiently robust that the tuning circuits 1206 may be omitted without loss of performance. Thus, the tuning circuits 1206 are optional from the standpoint of practicing the invention even though desirable in certain implementations.

The signals reflect back through the MMIC amplifiers 1209 to the circulator 1212 which then directs it along the traveling wave phase shift line 112' whereupon it is transmitted from the antenna component 1200 through the one-bit fixed phase shifters 115 and radiating elements 118. In the receive mode, the antenna component performs as do the embodiments disclosed above, the received signal being output over the connection 1215 through the circulator 1212.

The redundant receivers required by a conventional T/R approach to overcome the phase shifters are eliminated due to the dense microstrip's improved efficiency. The removal of the receiver greatly improves the transmit amplifier design by allowing more gain, volume, and thermal management options. These features add up to provide a solution for an Active Electronically Scanned Array that is better suited for some low-cost, high performance applications, e.g., missiles.

Thus, the dense microstrip antenna is a unique approach that eliminates the lossy multi-bit phase shifter and thereby opens the door to both a low-cost passive and novel affordable active antenna at Ka band. The antenna uses a 1 bit phase shifter combined with a dense (~1/10) element spacing to achieve beam steering. The antenna uses a simple efficient traveling slow wave feed structure to deliver power to the dense microstrip antenna elements. The simple traveling wave feed network eliminates the usual corporate feed network. The antenna is constructed of building blocks of microstrip boards called "slats" that are essentially self-contained linear arrays. The slats are then stacked to form the 2D planar array. Feed inputs to one-half of each slat enable a quadrant topology to support monopulse processing.

The present invention would utilize cost effective wafer level microstrip transmission lines in conjunction with a one bit/state fixed phase shifter to achieve low cost, high efficiency, high reliability, and greatly improved scanning performance over a mechanically scanned antenna by using a "grating" pattern to achieve beam steering. This solution greatly reduces the complexity, cost, and loss of the phase shifting element by only using a one bit phase shifter. Two-dimensional beam steering is achieved by superimposing a periodic one bit phase shift on the appropriate traveling wave linear phase shift using microstrip transmission lines.

This concludes the detailed description. The particular embodiments disclosed above are illustrative only, as the invention may be modified and practiced in different but equivalent manners apparent to those skilled in the art having the benefit of the teachings herein. For instance, alternative embodiments operating at lower millimeter-wave frequencies may be fabricated using technologies other than microstrip. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. An antenna component, comprising:

a coupler;

a ground plane;

a slow wave, traveling wave phase shift line electrically connected to the coupler and grounded to the ground plane; and a plurality of fixed phase shifters, each fixed phase shifter electrically connected to the traveling wave phase shift line at a respective point thereon.

2. The antenna component of claim 1, wherein the plurality of fixed phase shifters electrically connected to the traveling wave phase shift line includes a fixed phase shifter directly electrically connected or capacitively coupled to the traveling wave phase shift line.

3. The antenna component of claim 1, further comprising a plurality of radiating elements electromagnetically connected to a respective one of the fixed phase shifters.

4. The antenna component of claim 1, wherein the antenna component comprises a radiating component.

5. The antenna component of claim 1, further comprising:

a second coupler; and a second slow wave traveling wave phase shift line electrically connected to the second coupler.

6. The antenna component of claim 1, wherein the antenna component comprises a coupling antenna component.

7. The antenna component of claim 1, wherein the traveling wave phase shift line comprises a meander line or a slow wave structure.

8. The antenna component of claim 1, further comprising means for re-formatting control signals.

9. The antenna component of claim 1, wherein the fixed phase shifters include one-bit fixed phase shifters.

10. The antenna component of claim 1, further comprising an active circuit electrically connected between the coupler and the traveling wave phase shift line.

11. The antenna component of claim 10, wherein the active circuit comprises at least one amplifier and a circulator.

12. The antenna component of claim 11, wherein the active circuit further comprises a tuning circuit.

13. An antenna component, comprising:

means for radiating energy;

means for feeding a radio-frequency signal to the radiating means;

means for steering the energy radiated by the radiating means, the steering means being electrically connected to the feeding means; and means for coupling the feeding means to a radio-frequency signal source.

14. The antenna component of claim 13, wherein the radiating means comprises a plurality of radiating elements.

15. The antenna component of claim 14, wherein the radiating elements comprise slot, patch, flared notch, or dipole radiating elements.

16. The antenna component of claim 13, wherein the feeding means comprises a traveling wave phase shift line.

17. The antenna component of claim 16, wherein the traveling wave phase shift line comprises a meander line or a slow wave structure.

18. The antenna component of claim 13, wherein the coupling means comprises an edge connection.

19. The antenna component of claim 13, wherein the steering means comprises a plurality of fixed phase shifters, each fixed phase shifter electrically connected to the feeding means at a respective point thereon.

20. The antenna component of claim 19, wherein the fixed phase shifters include one-bit fixed phase shifters.

21. The antenna component of claim 13, farther comprising means for re-formatting control signals.

22. The antenna component of claim 21, wherein the re-formatting means comprises a programmable logic device.

23. The antenna component of claim 13, further comprising an active means connected between the coupling means and the steering means.

24. The antenna component of claim 23, wherein the active means comprises at least one amplifier and a circulator.

25. The antenna component of claim 24, wherein the active means further comprises a tuning circuit.

26. An antenna component, comprising:

a substrate;

a coupler formed in the substrate;

a slow wave traveling wave phase shift line fabricated in the substrate and electrically connected to the coupler;

a plurality of fixed phase shifters fabricated in the substrate, each fixed phase shifter capable of being coupled to the traveling wave phase shift line at a respective point thereon;

a backplane insulated from the traveling wave phase shift line by the substrate; and an interconnect through the substrate electrically connecting the traveling wave phase shift line and the backplane.

27. The antenna component of claim 26, further comprising a plurality of radiating elements electromagnetically connected to a respective one of the fixed phase shifters.

28. The antenna component of claim 26, further comprising:

a second coupler formed in the substrate;

a second slow wave, traveling wave phase shift line fabricated in the substrate and electrically connected to the second coupler; and a second interconnect through the substrate electrically connecting the traveling wave phase shift line and the backplane.

29. The antenna component of claim 26, wherein the traveling wave phase shift line comprises a meander line or a slow wave structure.

30. The antenna component of claim 26, further comprising means for re-formatting control signals.

31. The antenna component of claim 26, wherein the fixed phase shifters include one-bit fixed phase shifters.

32. The antenna component of claim 26, further comprising an active circuit electrically connected between the coupler and the traveling wave phase shift line.

33. The antenna component of claim 32, wherein the active circuit comprises at least one amplifier and a circulator mounted to the substrate.

34. The antenna component of claim 33, wherein the active circuit further comprises a tuning circuit fabricated in the substrate.

35. An antenna, comprising:

a plurality of microstrip radiating components, each radiating component including:

a slow wave, traveling wave phase shift line;

a plurality of fixed phase shifters, each fixed phase shifter capable of being coupled to the traveling wave phase shift line at a respective point thereon; and a plurality of uniformly distributed radiating elements, each radiating element being electromagnetically connected to a respective one of the fixed phase shifters; and a microstrip coupling component capable of being coupled and driving each of the radiating components, the coupling component including:

a traveling wave phase shift line; and a plurality of couplings.

36. The antenna of claim 35, wherein the radiating components are stacked.

37. The antenna of claim 35, further comprising a second coupling component.

38. The antenna of claim 37, wherein the radiating components are stacked into halves to create a quadrapole monopulse antenna.

39. The antenna of claim 35, wherein the antenna is generally conically shaped.

40. The antenna of claim 35, wherein the generally conically shaped antenna is generally circularly shaped.

41. The antenna of claim 35, wherein the coupling component is oriented orthogonally to the radiating components.

42. The antenna of claim 35, wherein the coupling component is oriented coincident with the radiating components.

43. The antenna of claim 42, wherein the radiating components are stacked on the coupling component.

44. The antenna of claim 35, wherein the fixed phase shifters include one-bit fixed phase shifters.

45. The antenna component of claim 35, wherein the radiating components further comprise an active circuit electrically connected between the couplings and the traveling wave phase shift line.

46. The antenna component of claim 45, wherein the active circuit comprises at least one amplifier and a circulator.

47. The antenna component of claim 46, wherein the active circuit further comprises a tuning circuit.

48. An antenna, comprising:

a radiating antenna component, including:

a coupler;

a ground plane;

a slow wave traveling wave phase shift line electrically connected to the coupler and grounded to the ground plane;

a plurality of fixed phase shifters, each fixed phase shifter capable of being coupled to the traveling wave phase shift line at a respective point thereon; and a plurality of radiating elements electromagnetically connected to a respective one of the fixed phase shifters; and a coupling component to which the radiating antenna component is coupled to receive control signals and a radio frequency feed.

49. The antenna of claim 48, further comprising a plurality of radiating elements electromagnetically connected to a respective one of the fixed phase shifters.

50. The antenna of claim 48, further comprising:

a second coupler; and a second slow wave, traveling wave phase shift line electrically connected to the second coupler.

51. The antenna of claim 48, wherein the traveling wave phase shift line comprises a slow-wave structure microstrip.

52. The antenna of claim 48, wherein the traveling wave phase shift line comprises a meander line or a slow wave structure.

53. The antenna of claim 48, further comprising means for re-formatting control signals.

54. The antenna of claim 48, wherein the fixed phase shifters include one-bit fixed phase shifters.

55. The antenna component of claim 48, wherein the radiating antenna component further comprises an active circuit electrically connected between the coupler and the traveling wave phase shift line.

56. The antenna component of claim 55, wherein the active circuit comprises at least one amplifier and a circulator.

57. The antenna component of claim 56, wherein the active circuit further comprises a tuning circuit.

* * * * *

UNITED STATES PATENT AND TRADEMARK OFFICE

CERTIFICATE OF CORRECTION

PATENT NO. : 7,532,171 B2
APPLICATION NO. : 11/421504
DATED : May 12, 2009
INVENTOR(S) : Cole A. Chandler It is certified that error appears in the above-identified patent and that said Letters Patent is hereby corrected as shown below:

Column 16, line 3: delete "farther" and insert --further--

Signed and Sealed this

Twenty-fifth Day of August, 2009

David J. Kappos

David J. Kappos
*Director of the United States Patent and Trademark Office*